US011359568B1

(12) United States Patent
Oshinsky et al.

(10) Patent No.: US 11,359,568 B1
(45) Date of Patent: Jun. 14, 2022

(54) METHODS AND SYSTEMS FOR FUEL INJECTION CONTROL

(71) Applicant: Ford Global Technologies, LLC, Dearborn, MI (US)

(72) Inventors: David Oshinsky, Trenton, MI (US); Mark Skilling, Tonbridge (GB); Ross Pursifull, Dearborn, MI (US); Michael Uhrich, Wixom, MI (US); Joseph Lyle Thomas, Farmington Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/198,106

(22) Filed: Mar. 10, 2021

(51) Int. Cl.

| | |
|---|---|
| ***F02D 41/20*** | (2006.01) |
| ***F02D 41/24*** | (2006.01) |
| ***F02D 41/22*** | (2006.01) |
| *F02D 41/14* | (2006.01) |

(52) U.S. Cl.
CPC ..... *F02D 41/20* (2013.01); *F02D 41/221* (2013.01); *F02D 41/2467* (2013.01); *F02D 2041/1433* (2013.01); *F02D 2041/2065* (2013.01); *F02D 2041/224* (2013.01); *F02D 2200/0614* (2013.01)

(58) Field of Classification Search
CPC ..... F02D 41/20; F02D 41/221; F02D 41/24; F02D 41/2467; F02D 2041/1433; F02D 2041/1065; F02D 2041/224; F02D 2200/0614
See application file for complete search history.

(56) References Cited

U.S. PATENT DOCUMENTS

| | | | | |
|---|---|---|---|---|
| 7,717,088 | B2 | 5/2010 | Thomas | |
| 10,184,416 | B2 | 1/2019 | Morris et al. | |
| 10,428,751 | B2 | 10/2019 | Uhrich et al. | |
| 10,731,593 | B2 * | 8/2020 | Surnilla | F02D 41/3863 |
| 10,844,804 | B2 * | 11/2020 | Pursifull | F02D 41/3094 |
| 10,865,721 | B1 | 12/2020 | Thomas et al. | |
| 10,900,436 | B2 * | 1/2021 | Pursifull | F02D 41/0085 |
| 10,947,923 | B2 | 3/2021 | Pursifull et al. | |
| 10,954,880 | B1 | 3/2021 | Thomas et al. | |
| 10,989,132 | B2 | 4/2021 | Thomas et al. | |
| 2020/0116099 | A1 * | 4/2020 | Surnilla | F02D 41/0085 |

OTHER PUBLICATIONS

Pursifull, R. et al., "Method and System for Adjusting Operation of a Fuel Injector," U.S. Appl. No. 17/039,589, filed Sep. 30, 2020, 36 pages.
Kiwan, R. et al., "Method and System for Fuel Injector Balancing," U.S. Appl. No. 17/093,384, filed Nov. 9, 2020, 62 pages.

* cited by examiner

*Primary Examiner* — John Kwon
*Assistant Examiner* — Johnny H Hoang
(74) *Attorney, Agent, or Firm* — Vincent Mastrogiacomo; McCoy Russell LLP

(57) ABSTRACT

Methods and systems are provided for a fuel system. In one example, a method includes comparing a resistance of a solenoid coil of a direct injector to a threshold resistance. The method further includes selecting one of a transient or a steady-state pressure-based injector balancing (PBIB) model in response to the comparison.

6 Claims, 7 Drawing Sheets

METHODS AND SYSTEMS FOR FUEL INJECTION CONTROL

FIELD

The present description relates generally to correcting fuel injector errors.

BACKGROUND/SUMMARY

Engines may be configured to deliver fuel to an engine cylinder using one or more of port and direct injection. Port fuel direct injection (PFDI) engines may be capable of leveraging both fuel injection systems. For example, at high engine loads, fuel may be directly injected into an engine cylinder via a direct injector, thereby leveraging the charge cooling properties of the direct injection (DI). At lower engine loads and at engine starts, fuel may be injected into an intake port of the engine cylinder via a port fuel injector, reducing particulate matter emissions. During still other conditions, a portion of fuel may be delivered to the cylinder via the port injector while a remainder of the fuel is delivered to the cylinder via the direct injector.

Over time, discrepancies between the injectors of the cylinders may develop, resulting in inaccurate fueling. To compensate for injector variability, correction coefficients determined for correcting injection parameters may be used. However, one difficult variation to correct may occur following a period of disuse. Upon reactivation following a threshold duration of deactivation, the fuel injectors may inject lean for some amount of time, which may impact engine operation.

One example approach is shown by Morris et al. in U.S. Pat. No. 10,184,416. Therein, an injector tip temperature is modeled and operation of the fuel injector is adjusted based on the model. If the injectors have been deactivated and a reactivation is requested, then the fuel pulse width is adjusted to compensate for the lean fueling errors that may follow a deactivation.

However, the inventors have identified some issues with the approaches described above. For example, the temperature model of Morris relies on multiple injections in order to correct injection errors. Thus, following a period of DI deactivation with PFI occurring, a restart of the DI may include multiple undesirably lean fuel injections prior to any correction being executed. Morris further teaches applying a determined correction as a factor on the basis that empirical data suggests injectors with a hot tip may inject undesirably lean. The inventors have identified that the injector tip temperature is not responsible for the undesirably lean injection, but that a solenoid coil with increased resistance while hot results in a longer opening time. Thus, the resulting error is an offset error, not a multiplicative error. Thus, the correction factor of Morris, which is a multiplicative factor, does not correct the lean fueling phenomenon.

In one example, the issues described above may be at least partially solved by a method for executing a transient pressure-based injector balancing (PBIB) model in response to a resistance of a solenoid coil of an injector being greater than a threshold resistance. In this way, two PBIB models may be learned and used, the transient PBIB model and a steady-state PBIB model.

As one example, the steady-state PBIB model is not updated during the transient phase operation of the injector. Likewise, the transient PBIB model is not updated during steady-state operation of the injector. In one example, two PBIB models may exist, the steady-state PBIB model used during steady state injector operation and the transient PBIB model used during transient injector operation. Feedback from the transient PBIB model may be used to adjust injecting parameters during the transient phase such that undesirably lean injections are avoided due to solenoid coil conditions of the injector deviating from a learned condition during the steady state. Pulse width provided to the injector during the transient phase may be increased relative to steady state operations. An opening time of the injector may be extended and/or a closing time of the injector may be reduced to provide increased fueling to a combustion chamber. By doing this, undesirably lean fuel injections may be avoided.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
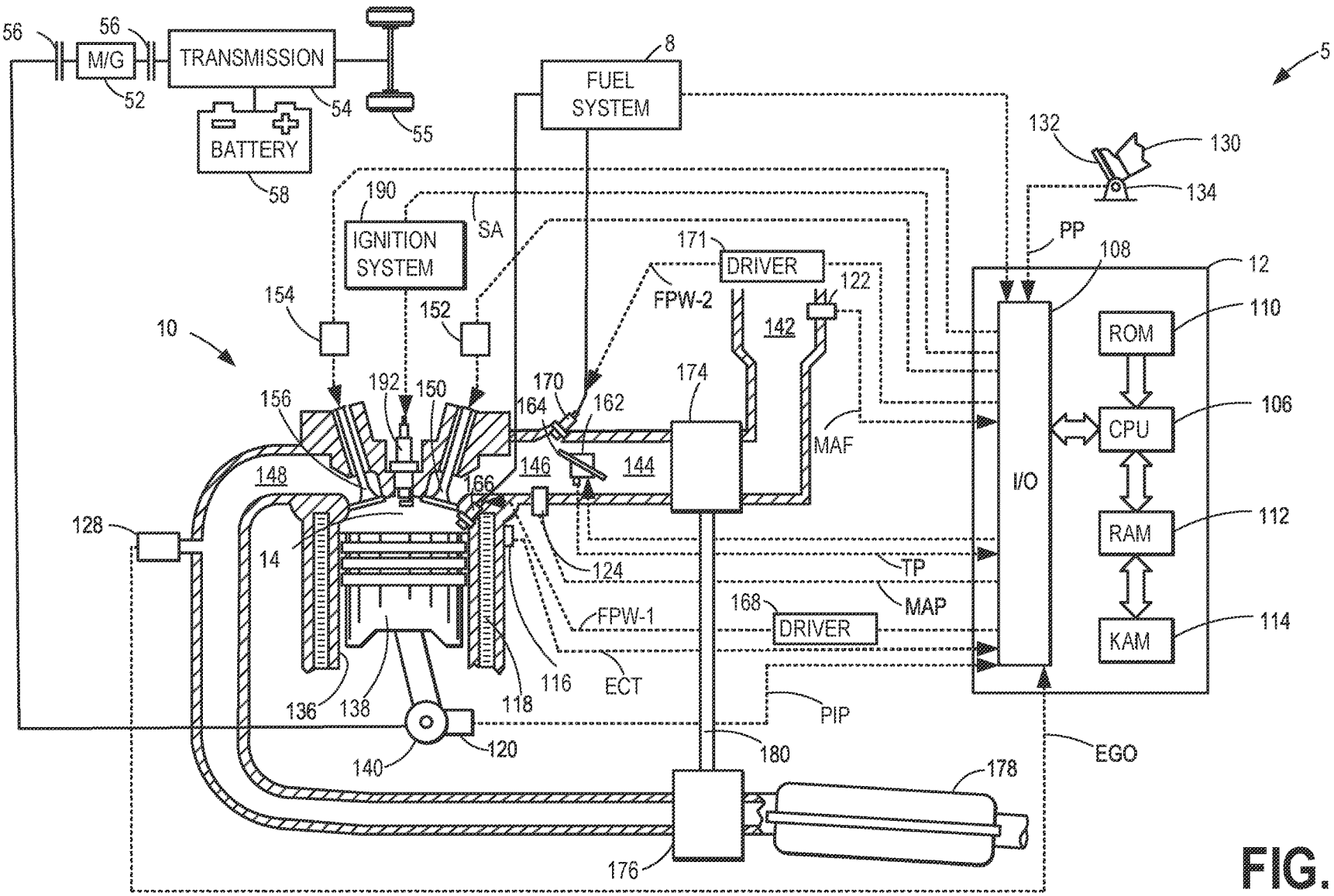
FIG. 1 shows an arrangement for the accommodation and post-treatment of an exhaust gas stream produced by an internal combustion engine in an exemplary embodiment together with an internal combustion engine.
Figure 2:
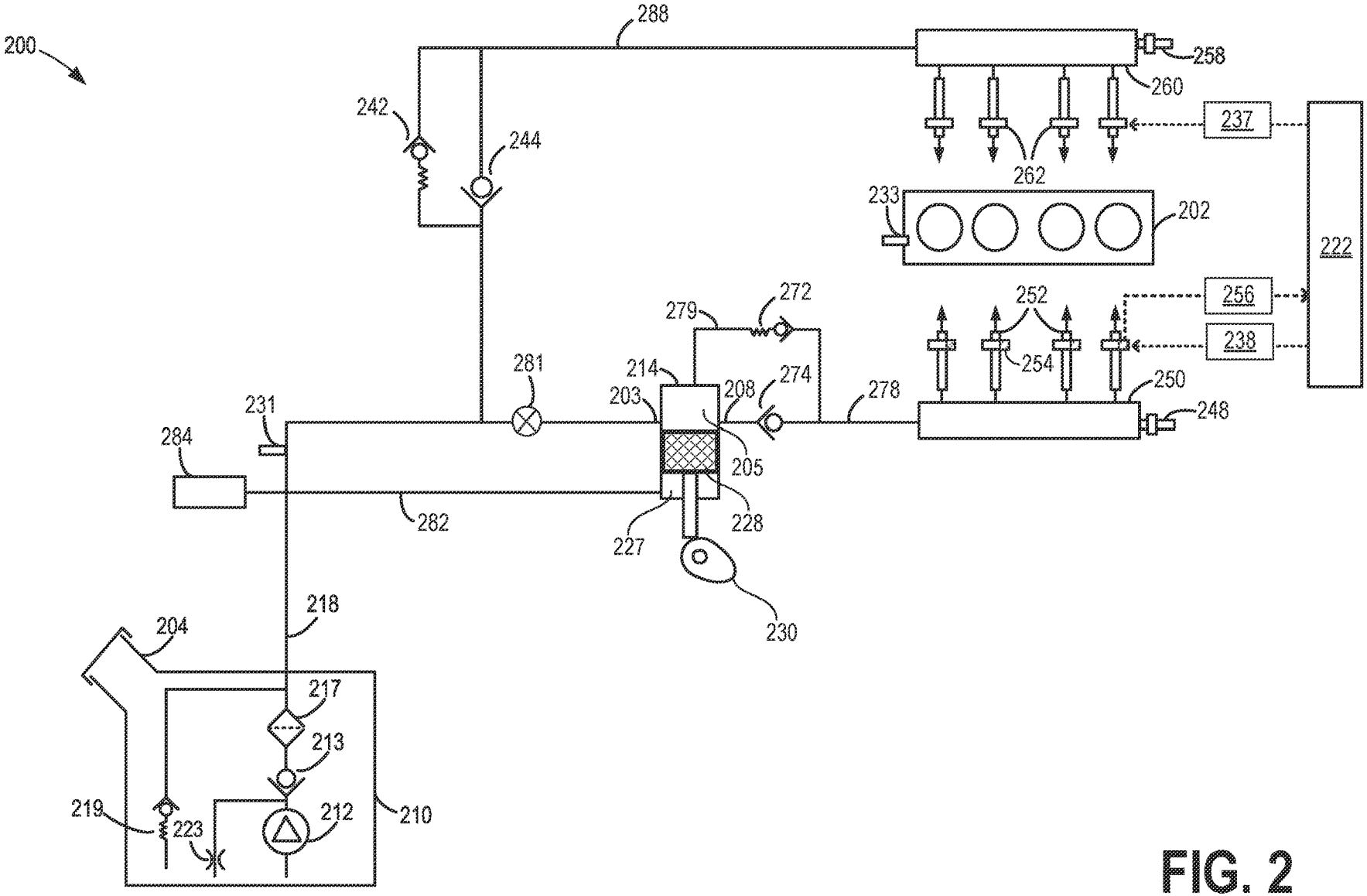
FIG. 2 illustrates a schematic of an engine included in a hybrid vehicle.
Figure 3:
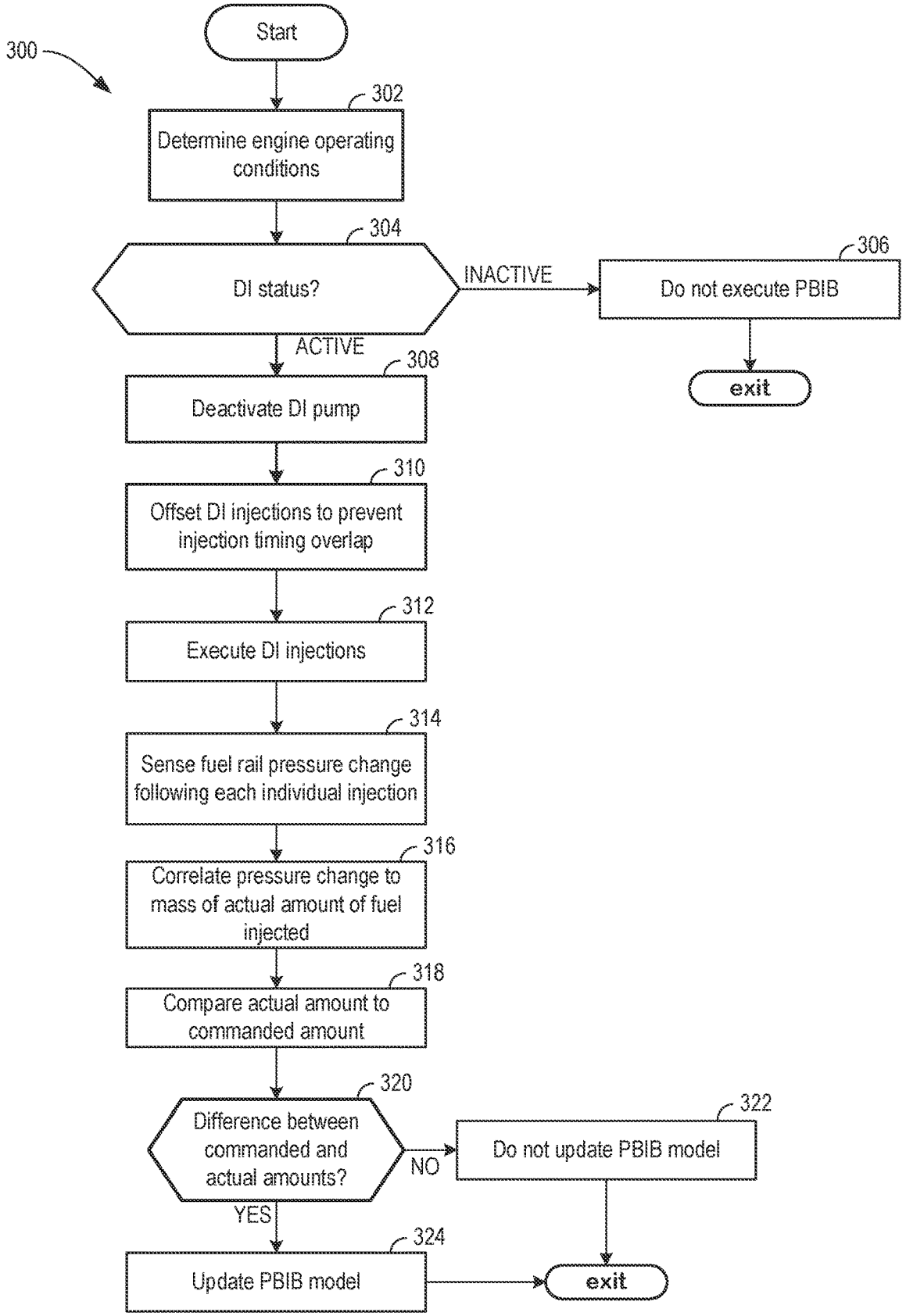
FIG. 3 illustrates a high level flow chart for executing a pressure based injector balancing (PBIB) routine.
Figure 4:
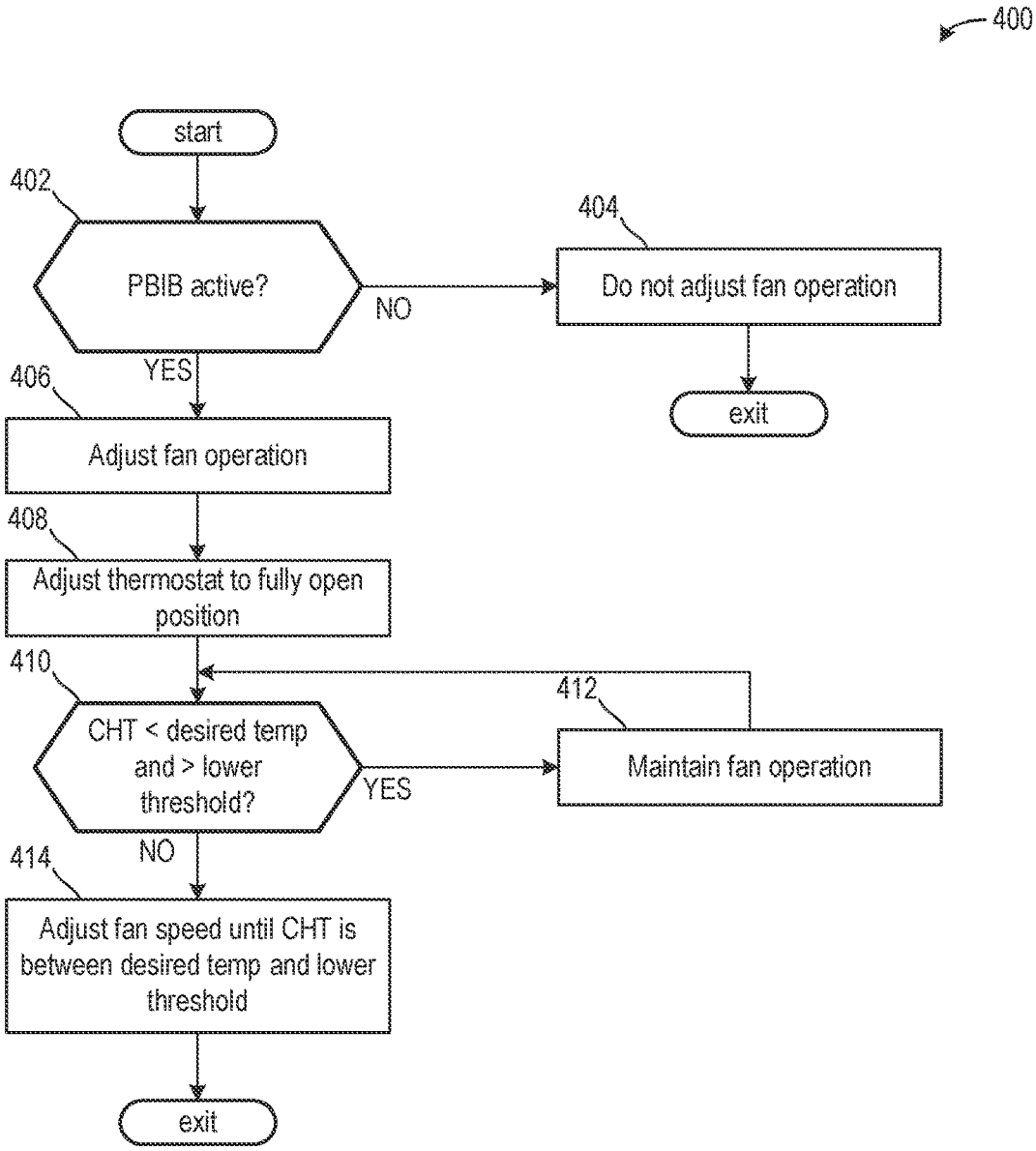
FIG. 4 illustrates a method for adjusting a fan operation when the PBIB routine is being executed.

The following description relates to systems and methods for adjusting operating parameters following a period of direct injector deactivation in conjunction with port-fuel injections being active. Systems illustrating an engine with direct injector and port-fuel injectors are illustrated in FIGS. 1 and 2. A high-level flow chart for executing and updating a PBIB model is illustrated in FIG. 3. A method for adjusting a cylinder heat temperature (CHT) during execution of the PBIB is shown in FIG. 4.

Figure 5:
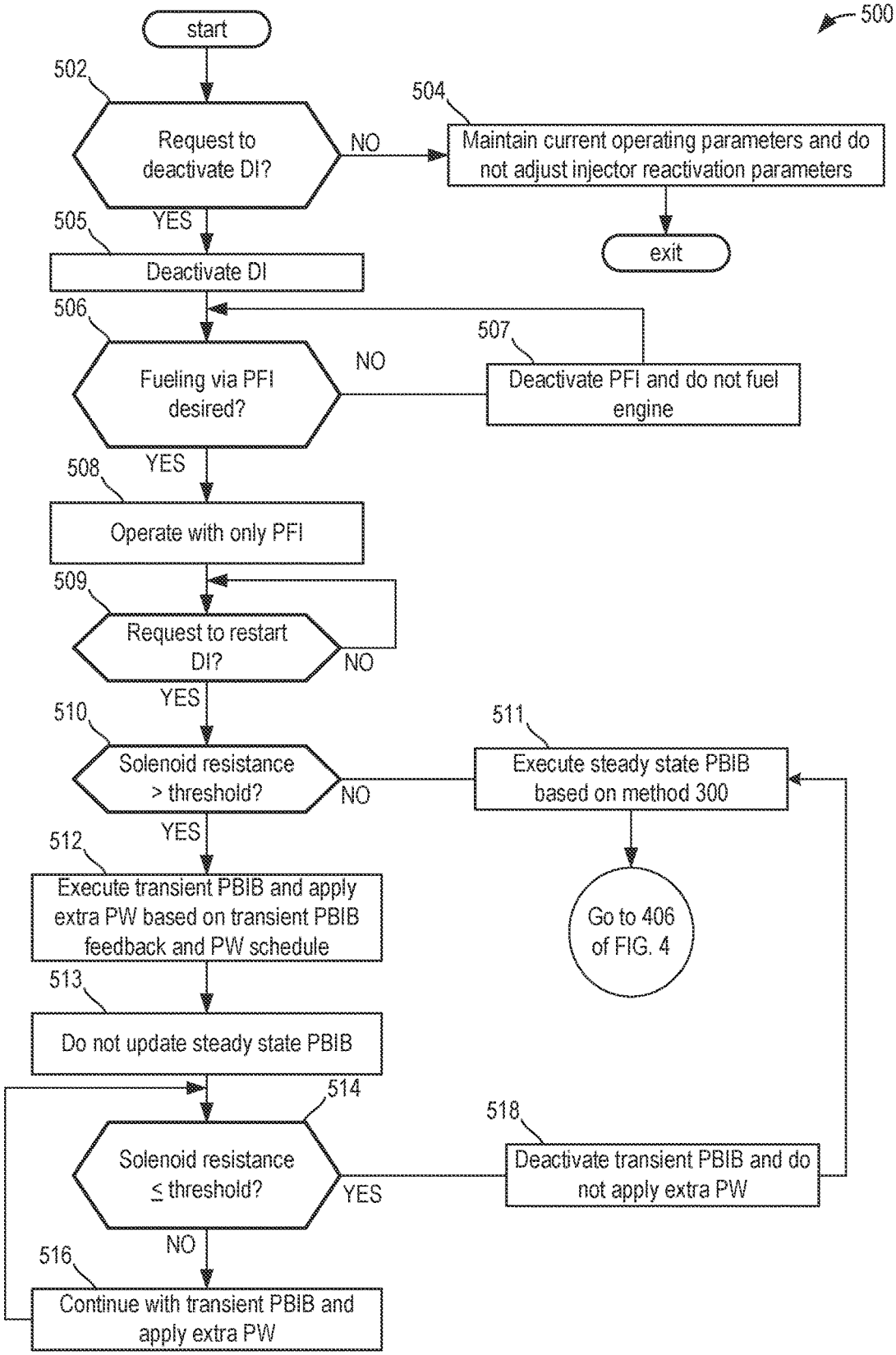
FIG. 5 illustrates a method for providing extra pulse width (PW) to a direct injector based on feedback from a transient PBIB routine during a transient operation of DI.
Figure 6A:
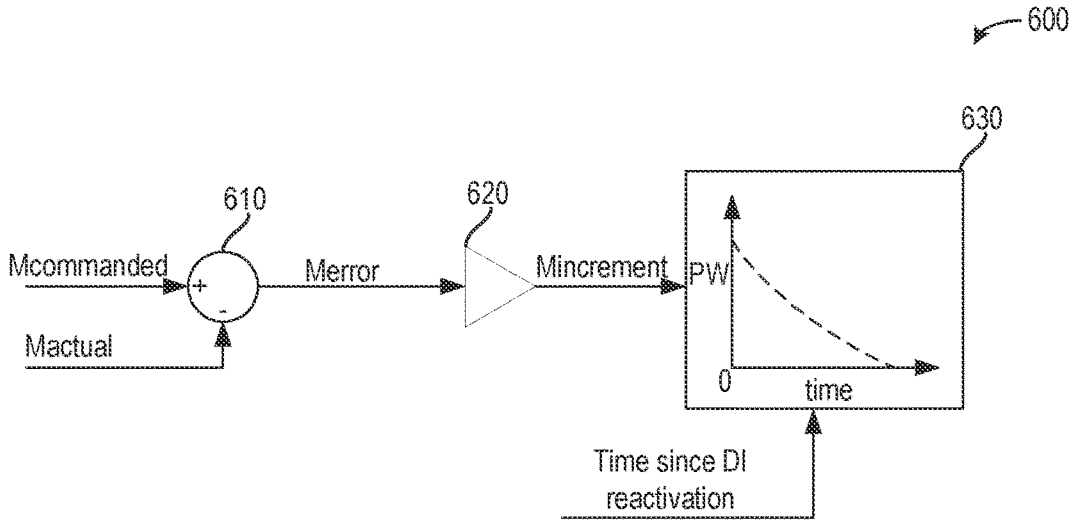
FIG. 6A illustrates an operation for updating a PW look-up table.
Figure 7:
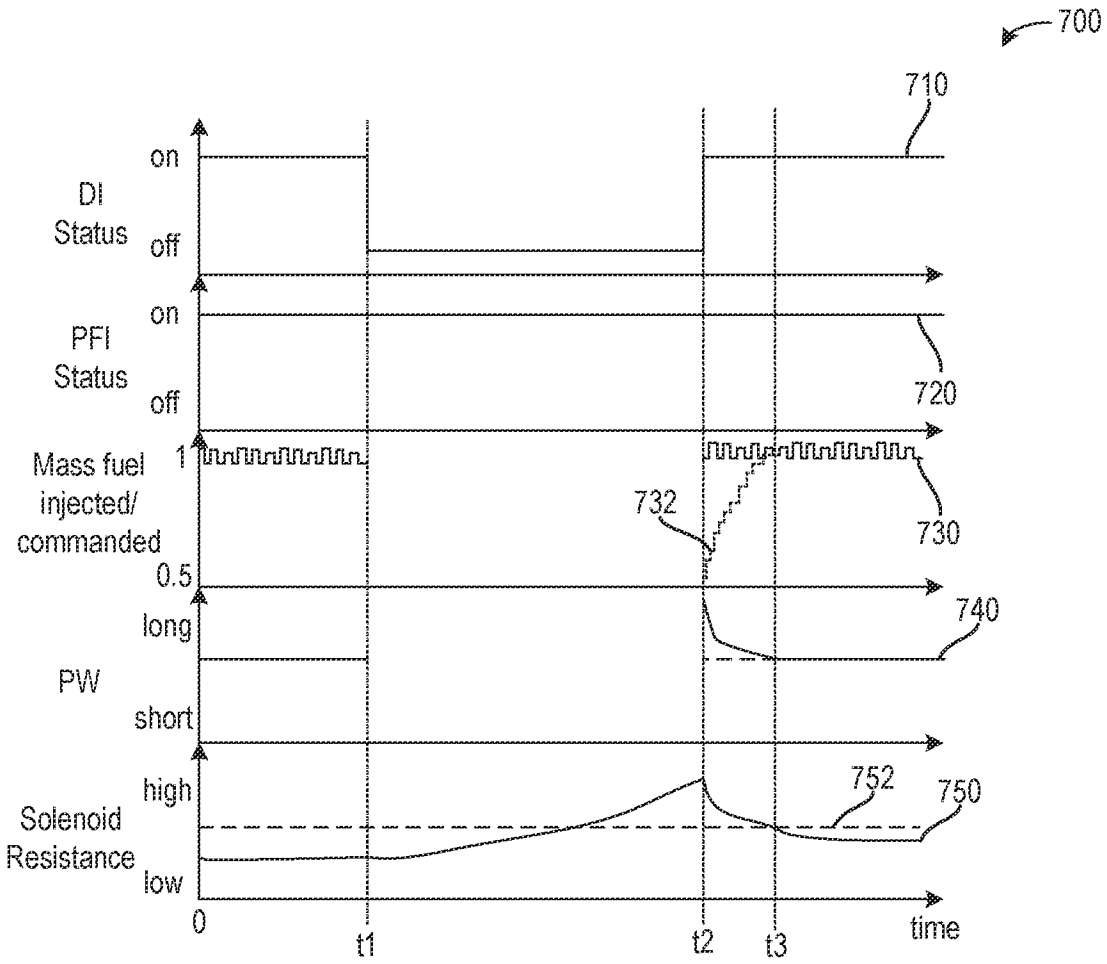
FIG. 7 illustrates a prophetic engine operating sequence illustrating PW adjustments in response to fueling conditions.

The PBIB model may be used when direct injection is active. In one example, the PBIB model may provide feedback regarding a PBIB determined fuel injection amount deviating from a commanded fuel injection amount upon restart of the direct injectors. In one example, based on a coil resistance, a PBIB model may be selected, wherein the PBIB model is a transient PBIB model or a steady state PBIB model. Execution of the transient PBIB model in response to the coil resistance being greater than a threshold resistance in combination with a learned PW model is illustrated in FIG. 5. Over time, PW provided to the direct injectors may be updated based on a sensed fueling in a look-up table, as shown in FIG. 6A. The look-up table, in combination with the PBIB model feedback, may be used to adjust direct injector PW parameters, as shown in FIG. 6A. An example of an engine operating sequence illustrating adjustments to the PW provided to the direct injectors is illustrated in FIG. 7.

FIGS. 1-2 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation).

FIG. 1 depicts an example of a combustion chamber or cylinder of internal combustion engine 10. Engine 10 may be coupled in a propulsion system for on-road travel, such as vehicle system 5. In one example, vehicle system 5 may be a hybrid electric vehicle system.

Engine 10 may be controlled at least partially by a control system including controller 12 and by input from a vehicle operator 130 via an input device 132. In this example, input device 132 includes an accelerator pedal and a pedal position sensor 134 for generating a proportional pedal position signal PP. Cylinder (herein also "combustion chamber") 14 of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system. Further, a starter motor (not shown) may be coupled to crankshaft 140 via a flywheel to enable a starting operation of engine 10.

Cylinder 14 can receive intake air via a series of intake air passages 142, 144, and 146. Intake air passage 146 can communicate with other cylinders of engine 10 in addition to cylinder 14. In some examples, one or more of the intake passages may include a boosting device such as a turbocharger or a supercharger. For example, FIG. 1 shows engine 10 configured with a turbocharger including a compressor 174 arranged between intake passages 142 and 144, and an exhaust turbine 176 arranged along exhaust passage 148. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine. A throttle 162 including a throttle plate 164 may be provided along an intake passage of the engine for varying the flow rate and/or pressure of intake air provided to the engine cylinders. For example, throttle 162 may be positioned downstream of compressor 174 as shown in FIG. 1, or alternatively may be provided upstream of compressor 174.

Exhaust passage 148 can receive exhaust gases from other cylinders of engine 10 in addition to cylinder 14. Exhaust gas sensor 128 is shown coupled to exhaust passage 148 upstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three-way catalyst (TWC), NOx trap, various other emission control devices, or combinations thereof.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder.

Intake valve 150 may be controlled by controller 12 via actuator 152. Similarly, exhaust valve 156 may be controlled by controller 12 via actuator 154. During some conditions, controller 12 may vary the signals provided to actuators 152 and 154 to control the opening and closing of the respective intake and exhaust valves. The position of intake valve 150 and exhaust valve 156 may be determined by respective valve position sensors (not shown). The valve actuators may be of the electric valve actuation type or cam actuation type, or a combination thereof. The intake and exhaust valve timing may be controlled concurrently or any of a possibility of variable intake cam timing, variable exhaust cam timing, dual independent variable cam timing or fixed cam timing may be used. Each cam actuation system may include one or more cams and may utilize one or more of cam profile switching (CPS), variable cam timing (VCT), variable valve timing (VVT) and/or variable valve lift (VVL) systems that may be operated by controller 12 to vary valve operation. For example, cylinder 14 may alternatively include an intake valve controlled via electric valve actuation and an exhaust valve controlled via cam actuation including CPS and/or VCT. In other examples, the intake and exhaust valves may be controlled by a common valve actuator or actuation system, or a variable valve timing actuator or actuation system.

Cylinder 14 can have a compression ratio, which is the ratio of volumes when piston 138 is at bottom center to top center. In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some examples, each cylinder of engine 10 may include a spark plug 192 for initiating combustion. Ignition system 190 can provide an ignition spark to combustion chamber 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

In some examples, each cylinder of engine 10 may be configured with one or more fuel injectors for providing fuel thereto. As a non-limiting example, cylinder 14 is shown including two fuel injectors 166 and 170. Fuel injectors 166 and 170 may be configured to deliver fuel received from fuel system 8. As elaborated with reference to FIG. 2, fuel system 8 may include one or more fuel tanks, fuel pumps, and fuel rails. Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection (hereafter referred to as "DI") of fuel into combustion cylinder 14. While FIG. 1 shows injector 166 positioned to one side of cylinder 14, it may alternatively be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from a fuel tank of fuel system 8 via a high pressure fuel pump, and a fuel rail. Further, the fuel tank may have a pressure transducer providing a signal to controller 12.

Fuel injector 170 is shown arranged in intake passage 146, rather than in cylinder 14, in a configuration that provides what is known as port injection of fuel (hereafter referred to as "PFI") into the intake port upstream of cylinder 14. Fuel injector 170 may inject fuel, received from fuel system 8, in proportion to the pulse width of signal FPW-2 received from controller 12 via electronic driver 171. Note that a single driver 168 or 171 may be used for both fuel injection systems, or multiple drivers, for example driver 168 for fuel injector 166 and driver 171 for fuel injector 170, may be used, as depicted.

In an alternate example, each of fuel injectors 166 and 170 may be configured as direct fuel injectors for injecting fuel directly into cylinder 14. In still another example, each of fuel injectors 166 and 170 may be configured as port fuel injectors for injecting fuel upstream of intake valve 150. In yet other examples, cylinder 14 may include only a single fuel injector that is configured to receive different fuels from the fuel systems in varying relative amounts as a fuel mixture, and is further configured to inject this fuel mixture either directly into the cylinder as a direct fuel injector or upstream of the intake valves as a port fuel injector. As such, it should be appreciated that the fuel systems described herein should not be limited by the particular fuel injector configurations described herein by way of example.

Fuel may be delivered by both injectors to the cylinder during a single cycle of the cylinder. For example, each injector may deliver a portion of a total fuel injection that is combusted in cylinder 14. Further, the distribution and/or relative amount of fuel delivered from each injector may vary with operating conditions, such as engine load, knock, and exhaust temperature, such as described herein below. The port injected fuel may be delivered during an open intake valve event, closed intake valve event (e.g., substantially before the intake stroke), as well as during both open and closed intake valve operation. Similarly, directly injected fuel may be delivered during an intake stroke, as well as partly during a previous exhaust stroke, during the intake stroke, and partly during the compression stroke, for example. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof.

Additionally or alternatively, during some operating conditions, one or more of the injectors may be deactivated for a duration of time. For example, during engine loads less than a high load, the fuel injectors 166 may be deactivated and the cylinder 14 may be fueled solely via the fuel injectors 170.

Fuel injectors 166 and 170 may have different characteristics. These include differences in size, for example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among injectors 170 and 166, different effects may be achieved.

Fuel tanks in fuel system 8 may hold fuels of different fuel types, such as fuels with different fuel qualities and different fuel compositions. The differences may include different alcohol content, different water content, different octane, different heats of vaporization, different fuel blends, and/or combinations thereof etc. One example of fuels with different heats of vaporization could include gasoline as a first fuel type with a lower heat of vaporization and ethanol as a second fuel type with a greater heat of vaporization. In another example, the engine may use gasoline as a first fuel type and an alcohol containing fuel blend such as E85 (which is approximately 85% ethanol and 15% gasoline) or M85 (which is approximately 85% methanol and 15% gasoline) as a second fuel type. Other feasible substances include water, methanol, a mixture of alcohol and water, a mixture of water and methanol, a mixture of alcohols, etc.

In still another example, both fuels may be alcohol blends with varying alcohol composition wherein the first fuel type may be a gasoline alcohol blend with a lower concentration of alcohol, such as E10 (which is approximately 10% ethanol), while the second fuel type may be a gasoline alcohol blend with a greater concentration of alcohol, such as E85 (which is approximately 85% ethanol). Additionally, the first and second fuels may also differ in other fuel qualities such as a difference in temperature, viscosity, octane number, etc. Moreover, fuel characteristics of one or both fuel tanks may vary frequently, for example, due to day to day variations in tank refilling.

Controller 12 is shown in FIG. 1 as a microcomputer, including microprocessor unit 106, input/output ports 108, an electronic storage medium for executable programs and calibration values shown as non-transitory read only memory chip 110 in this particular example for storing executable instructions, random access memory 112, keep alive memory 114, and a data bus. Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; and absolute manifold pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold. The controller 12 receives signals from the various sensors of FIG. 1 and employs the various actuators of FIG. 1 to adjust engine operation based on the received signals and instructions stored on a memory of the controller. For example, based on a pulse width signal commanded by the controller to a driver coupled to the direct injector, a fuel pulse may be delivered from the direct injector into a corresponding cylinder.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

In some examples, vehicle 5 may be a hybrid vehicle with multiple sources of torque available to one or more vehicle wheels 55. In other examples, vehicle 5 is a conventional vehicle with only an engine, or an electric vehicle with only electric machine(s). In the example shown, vehicle 5 includes engine 10 and an electric machine 52. Electric machine 52 may be a motor or a motor/generator. Crankshaft 140 of engine 10 and electric machine 52 are connected via a transmission 54 to vehicle wheels 55 when one or more clutches 56 are engaged. In the depicted example, a first clutch 56 is provided between crankshaft 140 and electric machine 52, and a second clutch 56 is provided between electric machine 52 and transmission 54. Controller 12 may send a signal to an actuator of each clutch 56 to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power from a traction battery 58 to provide torque to vehicle wheels 55. Electric machine 52 may also be operated as a generator to provide electrical power to charge battery 58, for example during a braking operation.

FIG. 2 schematically depicts an example embodiment 200 of a fuel system, such as fuel system 8 of FIG. 1. Fuel system 200 may be operated to deliver fuel to an engine, such as engine 10 of FIG. 1. Fuel system 200 may be operated by a controller to perform some or all of the operations described with reference to the methods described below.

Fuel system 200 includes a fuel storage tank 210 for storing the fuel on-board the vehicle, a lower pressure fuel pump (LPP) 212 (herein also referred to as fuel lift pump 212), and a higher pressure fuel pump (HPP) 214 (herein also referred to as fuel injection pump 214). Fuel may be provided to fuel tank 210 via fuel filling passage 204. In one example, LPP 212 may be an electrically-powered lower pressure fuel pump disposed at least partially within fuel tank 210. LPP 212 may be operated by a controller 222 (e.g., controller 12 of FIG. 1) to provide fuel to HPP 214 via fuel passage 218. LPP 212 can be configured as what may be referred to as a fuel lift pump. As one example, LPP 212 may be a turbine (e.g., centrifugal) pump including an electric (e.g., DC) pump motor, whereby the pressure increase across the pump and/or the volumetric flow rate through the pump may be controlled by varying the electrical power provided to the pump motor, thereby increasing or decreasing the motor speed. For example, as the controller reduces the electrical power that is provided to lift pump 212, the volumetric flow rate and/or pressure increase across the lift pump may be reduced. The volumetric flow rate and/or pressure increase across the pump may be increased by increasing the electrical power that is provided to lift pump 212. As one example, the electrical power supplied to the lower pressure pump motor can be obtained from an alternator or other energy storage device on-board the vehicle, such as battery 58 of FIG. 1, whereby the control system can control the electrical load that is used to power the lower pressure pump. Thus, by varying the voltage and/or current provided to the lower pressure fuel pump, the flow rate and pressure of the fuel provided at the inlet of the higher pressure fuel pump 214 is adjusted.

LPP 212 may be fluidly coupled to a filter 217, which may remove small impurities contained in the fuel that could potentially damage fuel handling components. A check valve 213, which may facilitate fuel delivery and maintain fuel line pressure, may be positioned fluidly upstream of filter 217. With check valve 213 upstream of the filter 217, the compliance of low-pressure passage 218 may be increased since the filter may be physically large in volume. Furthermore, a pressure relief valve 219 may be employed to limit the fuel pressure in low-pressure passage 218 (e.g., the output from lift pump 212). Relief valve 219 may include a ball and spring mechanism that seats and seals at a specified pressure differential, for example. The pressure differential set-point at which relief valve 219 may be configured to open may assume various suitable values; as a non-limiting example the set-point may be 6.4 bar or 5 bar (g). An orifice 223 may be utilized to allow for air and/or fuel vapor to bleed out of the lift pump 212. This bleed at orifice 223 may also be used to power a jet pump used to transfer fuel from one location to another within the tank 210. In one example, an orifice check valve (not shown) may be placed in series with orifice 223. In some embodiments, fuel system 200 may include one or more (e.g., a series) of check valves fluidly coupled to low-pressure fuel pump 212 to impede fuel from leaking back upstream of the valves. In this context, upstream flow refers to fuel flow traveling from fuel rails 250, 260 towards LPP 212 while downstream flow refers to the nominal fuel flow direction from the LPP towards the HPP 214 and thereon to the fuel rails.

Fuel lifted by LPP 212 may be supplied at a lower pressure into a fuel passage 218 leading to an inlet 203 of HPP 214. Solenoid valve 281 located upstream of inlet 203 governs the fuel quantity that is compressed. HPP 214 may then deliver fuel into a first fuel rail 250 coupled to one or more fuel injectors of a first group of direct injectors 252 (herein also referred to as a first injector group). Fuel lifted by the LPP 212 may also be supplied to a second fuel rail 260 coupled to one or more fuel injectors of a second group of port injectors 262 (herein also referred to as a second injector group). HPP 214 may be operated to raise the pressure of fuel delivered to the first fuel rail above the lift pump pressure, with the first fuel rail coupled to the direct injector group operating with a high pressure. As a result, high pressure DI may be enabled while PFI may be operated at a lower pressure.

While each of first fuel rail 250 and second fuel rail 260 are shown dispensing fuel to four fuel injectors of the respective injector group 252, 262, it will be appreciated that each fuel rail 250, 260 may dispense fuel to any suitable number of fuel injectors. As one example, first fuel rail 250 may dispense fuel to one fuel injector of first injector group 252 for each cylinder of the engine while second fuel rail 260 may dispense fuel to one fuel injector of second injector group 262 for each cylinder of the engine. Controller 222 can individually actuate each of the port injectors 262 via a port injection driver 237 and actuate each of the direct injectors 252 via a direct injection driver 238. The controller 222, the drivers 237, 238 and other suitable engine system controllers can comprise a control system. While the drivers 237, 238 are shown external to the controller 222, it should be appreciated that in other examples, the controller 222 can include the drivers 237, 238 or can be configured to provide the functionality of the drivers 237, 238. Controller 222 may include additional components not shown, such as those included in controller 12 of FIG. 1.

The first injector group 252 (e.g., the high-pressure injector group and/or the direct injection group) includes a plurality of injectors, each illustrated including a solenoid 254. The solenoid 254 may comprise an electromagnetic coil configured to receive energy from the direct injection driver 238 to adjust an armature movement of a direct injector configured to open or close a portion of the injector, thereby adjusting a fluid coupling between an injector sac and a combustion chamber. A current sensor 256 may be configured to sense a resistance, current, voltage, or the like of the solenoid 254, which may be used to determine if the first injector group 252 is operating within transient condition parameters or steady state parameters. Additionally or alternatively, the current sensor 256 may be replaced with or combined with a temperature sensor, wherein a temperature of the solenoid 254 may be used to determine if transient or steady-state condition parameters are present.

HPP 214 may be an engine-driven, positive-displacement pump. As one non-limiting example, HPP 214 may utilize a solenoid activated control valve (e.g., fuel volume regulator, magnetic solenoid valve, etc.) to vary the effective pump volume of each pump stroke. The outlet check valve of HPP is mechanically controlled and not electronically controlled by an external controller. HPP 214 may be mechanically driven by the engine in contrast to the motor driven LPP 212. HPP 214 includes a pump piston 228, a pump compression chamber 205 (herein also referred to as compression chamber), and a step-room 227. Pump piston 228 receives a mechanical input from the engine crank shaft or cam shaft via cam 230, thereby operating the HPP according to the principle of a cam-driven single-cylinder pump. A sensor (not shown in FIG. 2) may be positioned near cam 230 to enable determination of the angular position of the cam (e.g., between 0 and 360 degrees), which may be relayed to controller 222. Step room 227 may also be directly coupled to fuel passage 218 via fuel line 282. An accumulator 284 may be coupled at the node.

A lift pump fuel pressure sensor 231 may be positioned along fuel passage 218 between lift pump 212 and higher pressure fuel pump 214. In this configuration, readings from sensor 231 may be interpreted as indications of the fuel pressure of lift pump 212 (e.g., the outlet fuel pressure of the lift pump) and/or of the inlet pressure of higher pressure fuel pump. Readings from sensor 231 may be used to assess the operation of various components in fuel system 200, to determine whether sufficient fuel pressure is provided to higher pressure fuel pump 214 so that the higher pressure fuel pump ingests liquid fuel and not fuel vapor, and/or to minimize the average electrical power supplied to lift pump 212.

First fuel rail 250 includes a first fuel rail pressure sensor 248 for providing an indication of direct injection fuel rail pressure to the controller 222. Likewise, second fuel rail 260 includes a second fuel rail pressure sensor 258 for providing an indication of port injection fuel rail pressure to the controller 222. An engine speed sensor 233 can be used to provide an indication of engine speed to the controller 222. The indication of engine speed can be used to identify the speed of higher pressure fuel pump 214, since the pump 214 is mechanically driven by the engine 202, for example, via the crankshaft or camshaft.

First fuel rail 250 is coupled to an outlet 208 of HPP 214 along fuel passage 278. A check valve 274 and a pressure relief valve (also known as pump relief valve) 272 may be positioned between the outlet 208 of the HPP 214 and the first (DI) fuel rail 250. The pump relief valve 272 may be coupled to a bypass passage 279 of the fuel passage 278. Outlet check valve 274 opens to allow fuel to flow from the high pressure pump outlet 208 into a fuel rail only when a pressure at the outlet of direct injection fuel pump 214 (e.g., a compression chamber outlet pressure) is higher than the fuel rail pressure. The pump relief valve 272 may limit the pressure in fuel passage 278, downstream of HPP 214 and upstream of first fuel rail 250. For example, pump relief valve 272 may limit the pressure in fuel passage 278 to 200 bar. Pump relief valve 272 allows fuel flow out of the DI fuel rail 250 toward pump outlet 208 when the fuel rail pressure is greater than a predetermined pressure. Valves 244 and 242 work in conjunction to keep the low pressure fuel rail 260 pressurized to a pre-determined low pressure. Pressure relief valve 242 helps limit the pressure that can build in fuel rail 260 due to thermal expansion of fuel.

Based on engine operating conditions, fuel may be delivered by one or more port injectors 262 and direct injectors 252. For example, during high load conditions, fuel may be delivered to a cylinder on a given engine cycle via only direct injection, wherein port injectors 262 are disabled. In another example, during mid-load conditions, fuel may be delivered to a cylinder on a given engine cycle via each of direct and port injection. As still another example, during low load conditions, engine starts, as well as warm idling conditions, fuel may be delivered to a cylinder on a given engine cycle via only port injection, wherein direct injectors 252 are disabled.

It is noted here that the high pressure pump 214 of FIG. 2 is presented as an illustrative example of one possible configuration for a high pressure pump. Components shown in FIG. 2 may be removed and/or changed while additional components not presently shown may be added to pump 214 while still maintaining the ability to deliver high-pressure fuel to a direct injection fuel rail and a port injection fuel rail.

Controller 12 can also control the operation of each of fuel pumps 212, and 214 to adjust an amount, pressure, flow rate, etc., of a fuel delivered to the engine. As one example, controller 12 can vary a pressure setting, a pump stroke amount, pump duty cycle command and/or fuel flow rate of the fuel pumps to deliver fuel to different locations of the fuel system. A driver (not shown) electronically coupled to controller 222 may be used to send a control signal to the low pressure pump, as required, to adjust the output (e.g., speed, flow output, and/or pressure) of the low pressure pump.

Since fuel injection from the direct injectors results in injector cooling, following a period of inactivity, pressure may build up from fuel trapped at the DI fuel rail 250, resulting in an elevated temperature and pressure being experienced at the DI fuel rail 250. In addition, direct injector tip temperatures may start to rise. In addition, due to the change in fuel density, the mass of fuel released at a given fuel pulse width may drop, resulting in a lean air-fuel ratio excursion.

The inventors herein have recognized that operation of the DI following the period of inactivity may present a circumstance where lean fueling may occur. While a DI tip temperature may be used to somewhat mitigate undesired lean fueling, feedback from the DI tip temperature model may be slow and need multiple fuel injections prior to corrections being executed. In one example, these drawbacks may be corrected via feedback form a current/voltage model in combination with a transient PBIB model. For example, the current/voltage model may quickly (e.g., instantly) determine a coil resistance during operating parameters, wherein if the resistance is above a threshold resistance, then a transient condition may be present. The coil resistance may increase as its temperature increases. While the coil resistance is proportional to its temperature, its cause is not due to the injector tip temperature. Thus, using the injector tip temperature to correct fueling errors during the transient operation is inaccurate and provides less than desired results. The transient PBIB, which is updated and executed separately from a steady state PBIB, may be used in combination with a PW schedule to correct fueling errors during the transient event caused by elevated coil resistance.

In this way, the system of FIGS. 1-2 enables an engine system comprising an engine cylinder including intake valve and an exhaust valve; a direct fuel injector for delivering fuel directly into the engine cylinder; a port fuel injector for delivering fuel into an intake port, upstream of the intake valve of the engine cylinder; a fuel rail providing fuel to each of the direct and port fuel injector; a temperature sensor coupled to the fuel rail; and a controller. The controller may be configured with computer readable instructions stored on non-transitory memory for: deactivating the direct fuel injector; in response to direct injector reactivation after a duration of engine fueling via port injection only, increasing a commanded direct injection fuel pulse width; and in response to direct injector reactivation after a duration of no engine fueling, decreasing the commanded direct injection fuel pulse width. In one example, a rate of the increasing may be raised as one or more of engine speed, engine load, spark timing retard, estimated fuel rail pressure, and duration of engine fueling increases. In another example, a rate of the decreasing may be raised responsive to one or more of the intake and exhaust valve remaining active during the duration of no engine fueling, and an increase in the duration of no engine fueling. The controller may include further instructions for estimating a fuel flow rate into the deactivated direct injector; and as the estimated fuel flow rate increases, reducing the rate of increasing in response to direct injector reactivation after the duration of engine fueling via port injection only; and raising the rate of decreasing in response to direct injector reactivation after the duration of no engine fueling.

Referring now to FIG. 3, a high level flow chart of an example method 300 for executing an adjusting a PBIB model is shown. The PBIB model may be a transient or steady state PBIB model. However, as will be described herein, the transient PBIB model and the steady state PBIB model may be executed separately and updated separately from one another such that conditions and learning parameters for each are different. The method of FIG. 3 may be incorporated into the system of FIG. 1 as executable instructions stored in controller non-transitory memory. In addition, other portions of method 300 may be performed via a controller transforming operating states of devices and actuators in the physical world. The controller may employ engine actuators of the engine system to adjust engine operation.

At 302, method 300 determines operating conditions. The engine and vehicle operating conditions may be determined via the sensors and actuators described herein. In one example, the operating conditions may include but are not limited to ambient temperature, ambient pressure, engine temperature, engine speed, vehicle speed, fuel rail pressure, and propulsive effort pedal position.

The method 300 proceeds to 304, which includes determining a DI status. The DI status may be active (e.g., injecting) or inactive (e.g., not injecting). If the DI status is inactive, then the method 300 proceeds to 306, which includes not executing the PBIB. Thus, neither the transient or the steady state PBIB is executed.

If the DI status is active, then the method 300 may proceed to 308, which includes deactivating the DI pump. The DI pump may correspond to a high pressure pump for a high pressure fuel rail fluidly coupled to the DI. For example, the higher pressure fuel pump 214 of FIG. 2 may be deactivated, thereby blocking pressure changes to the high pressure fuel rail as a result of new fuel being introduced thereto. As such, pressure change in the high pressure fuel rail may be a result of only the DI injecting fuel.

The method 300 may proceed to 310, which includes offsetting DI injections to prevent injection timing overlap. Thus, while a first direct injector is injecting fuel, another direct injector of the DI system may not inject fuel until the first direct injector stops injecting fuel. By doing this, the pressure change in the fuel rail may be directly correlated to injection via a single injector.

The method 300 may proceed to 312, which includes executing DI injections with the high-pressure pump closed and the injections being offset so that the PBIB may be executed as desired.

The method 300 may proceed to 314, which includes sensing a fuel rail pressure change following each individual injection. The fuel rail pressure change is stored in combination with a specific injector. For example, for a fuel rail fluidly coupled to four direct injectors, a first fuel rail pressure change is stored with a first injector, a second fuel rail pressure change is stored with a second injector, and so on.

The method 300 may proceed to 316, which includes correlating a fuel rail pressure change to an actual mass of fuel injected by a corresponding injector. In one example, the first fuel rail pressure change is correlated to a first actual mass of fuel injected by the first injector. The second fuel rail pressure change is correlated to a second actual mass of fuel injected by the second injector. The first actual mass and the second actual mass may be equal or different values. In some examples, additionally or alternatively, the fuel rail pressure change may be correlated to an actual volume of fuel injected.

The method 300 may proceed to 318, which includes comparing the actual amount of fuel injected to a commanded amount.

The method 300 may proceed to 320, which includes determining a difference between the commanded and actual amounts. In one example, the difference is calculated for each injector, wherein the difference is equal to an injector fueling error. If a difference is not present for one or more of the injectors, then the method 300 proceeds to 322, which includes not updating the PBIB model. As such, adjustments based on a current PBIB model may already be accurate and updates to the PBIB model may not be desired due to an injector fueling error not being present.

If a difference is present for one or more of the injectors, then the method 300 proceeds to 324, which includes updating the PBIB model. Updating the PBIB model may include updating injector fueling errors for one or more of the injectors that injected an amount of fuel different than the commanded amount of fuel. Based on updates to the PBIB model, future DI injections under similar conditions may be adjusted to limit and/or mitigate errors previously experienced. Updates to the PBIB model may be executed periodically or continuously. In one example, the updated PBIB model may adjust an injector command (e.g., pulse width) such that all direct injectors are identical once a pulse width provided thereto is adjusted to a desired value based on the learned error. Additionally or alternatively, a continually executed closed loop system may be used to adjust an average error between a commanded fuel mass and an actual fuel mass to zero.

Turning now to FIG. 4, it shows a method 400 for adjusting a fan operation during execution of the PBIB, as discussed above with respect to FIG. 3. In one example, the fan operation is adjusted to maintain a relatively contact cylinder head temperature (CHT). In one example, the fan is a radiator fan. However, other fans may be used without departing from the scope of the present disclosure.

The method 400 begins at 402, which includes determining if PBIB is active. As described above with respect to FIG. 3, PBIB may be active if the high-pressure pump is deactivated and DI injection timing is offset such that injections from different injectors do not overlap. If the PBIB is not active, then the method 400 proceeds to 404, which includes not adjusting the fan operation. As such, fan operation may be based on maintaining a desired cylinder head temperature, coolant temperature, or other temperature independent of an effect of the cylinder head temperature on PBIB learning and/or feedback.

If the PBIB is active, then the method 400 proceeds to 406, which includes adjusting a fan operation. The fan operation may be adjusted such that a fan speed is held relatively constant. In one example, outside of the PBIB execution, the fan operation may be periodically activated and deactivated, such that a cylinder head temperature follows a saw-tooth pattern with a desired temperature range. However, the variances between lower and higher temperature of the desired temperature range affect a solenoid resistance due to a winding of the solenoid being heated. This resistance change may result in a current change, which may affect an injector opening and closing force, thereby impacting PBIB results. By holding the fan speed relatively constant, the variances in cylinder head temperature may be avoided and PBIB results may be improved.

The method 400 may proceed to 408, which includes adjusting a thermostat to a fully open position. As such, coolant in the cylinder head may flow freely without interruption and/or slowing due to a position of the thermostat. In this way, the cylinder head temperature may be controlled via only the fan.

The method 400 may proceed to 410, which includes determining if the cylinder head temperature is less than the desired temperature range and greater than a lower threshold. In one example, the temperature range between the desired temperature range and the lower threshold corresponds to a cylinder head temperature less than an average targeted temperature outside of PBIB operation, wherein the average targeted temperature is an average of the desired temperature range. This may ensure that the solenoid winding temperature does not increase to a temperature where its resistance increases to a resistance greater than a threshold resistance, wherein the threshold resistance corresponds to a resistance where opening and closing times and/or forces of the injector are changed, resulting in fueling errors.

If the cylinder head temperature is between the desired temperature range and the lower threshold, then the method 400 may proceed to 412 to maintain the fan operation. If the cylinder head temperature is not between the desired temperature range and the lower threshold, then the method 400 may proceed to 414, which includes adjusting the fan speed until the cylinder head temperature is between the desired temperature range and the lower threshold. In one example, the fan speed is adjusted by adjusting one or more of a fan power, speed, voltage, current, and duty cycle. In this way, the fan speed is not adjusted based on a desired engine operating temperature or a desired coolant temperature, but in response to a sensed solenoid resistant based on a heating of the solenoid winding. In one example, if the cylinder head temperature is too high, then the fan speed may be increased. If the cylinder head temperature is too low, then the fan speed may be reduced.

In one example, the method 400 teaches adjusting a fan operation between a first mode and a second mode. The first mode may be selected when PBIB is not being executed and the second mode may be selected when PBIB is being executed. The first mode is configured to maintain the cylinder head temperature equal to an average desired temperature based on the extremes of the desired temperature range. This may be executed by oscillating a fan power, a fan speed, a fan duty cycle, or the like based on cooling provided by each of the fan and coolant flowing to the cylinder head. Thus, during the first mode, the cylinder head temperature may fluctuate, creating an undulating temperature profile. The second mode is configured to mitigate fluctuations in the cylinder head temperature. The fan operation is adjusted to constant or more uniform operation relative to the first mode such that a difference between maxima and minima of the cylinder head temperature during the second mode is lower than the difference during the first mode. In one example, to achieve a more uniform cylinder head temperature during the second mode, cooling is provided via only the fan. Thus, a thermostat is moved to a fully open position allowing coolant to flow freely out of the cylinder head. Additionally, the temperature achieved during the second mode may be a temperature lower than a minimum of the desired temperature range. By doing this, results learned during the PBIB execution may more accurate, thereby enhancing injecting errors for future DI injections. The fan operation may be adjusted for each of the transient PBIB and the steady-state PBIB.

Turning now to FIG. 5, it shows a method 500 for adjusting direct injector operating parameters based on feedback from a PBIB model, as described above with respect to methods 300 and 400.

The method 500 begins at 502, which includes determining if a request to deactivate the DI is present. The request to deactivate the DI may be based on one or more of an engine load decreasing to a relatively low load, an engine being shut-off, or a vehicle being shut-off. If the request is present, then the method 500 may proceed to 504, which includes maintaining current operating parameters and does not adjust injector reactivation parameters based on PBIB feedback in combination with a learned transient PW adjustment. In some examples, a steady state PBIB may be executed at 504 based on the methods 300 and 400 described above.

If the request to deactivate the DI is present, then the method 500 may proceed to 505, which includes deactivating the DI. In this way, fuel is not injected into the combustion chambers via the DI.

The method 500 may proceed to 506, which includes determining if fueling via PFI is desired. If fueling is not desired, then the method 500 may proceed to 507, which includes deactivating the PFI and not fueling the engine. Fueling may not be desired during an all-electric operation of the vehicle. Additionally or alternatively, fueling may not be desired during a start/stop, vehicle off, coasting event, or the like. The method 500 may continue to monitor a request for PFI fueling.

If PFI fueling is desired, then the method 500 proceeds to 508, which includes operating the engine with only the PFI being active. As such, an entire amount of commanded fuel is delivered via the PFI. During this time, the DI are inactive, which may result in a temperature of a solenoid winding the DI increasing.

The method 500 may proceed to 509, which includes determining if a request to restart the DI is present. The request may be present if an engine load has increased to a mid or a high load. If the request to restart the DI is not present, then the method continues to fuel the engine with only the PFI and maintains the DI inactive.

If the request is present, then the method 500 proceeds to 510, which includes determining if a solenoid resistance is greater than a threshold resistance. The threshold resistance may be based on a resistance where increased current (e.g., PW) is needed to drive operation of an injector relative to a steady state operation where resistance is less than or equal to the threshold. The resistance of the solenoid coil may be determined via the sensor 256 of FIG. 2, in one example. If the solenoid resistance is not greater than the threshold resistance, then the method 500 may proceed to 511, which includes executing a steady state PBIB based on method 300. As such, the transient PBIB is not executed. The method 500 may then proceed to 406 of FIG. 4 to adjust a fan operation as described above.

Additionally or alternatively, a temperature of the solenoid coil may be determined instead of or in combination with the solenoid resistance. The temperature may be determined via a temperature sensor, such as sensor 256 of FIG. 2. The temperature may be compared to a threshold temperature, wherein the threshold temperature is based on a temperature of the solenoid coil where opening and closing times are changed relative to temperatures below the threshold temperature such that fueling errors are increased to outside a desired tolerance. If the temperature is greater than the threshold temperature, then a transient condition may be occurring. If the temperature is less than or equal to the threshold temperature, than a steady-state condition may be occurring.

Figure 6B:
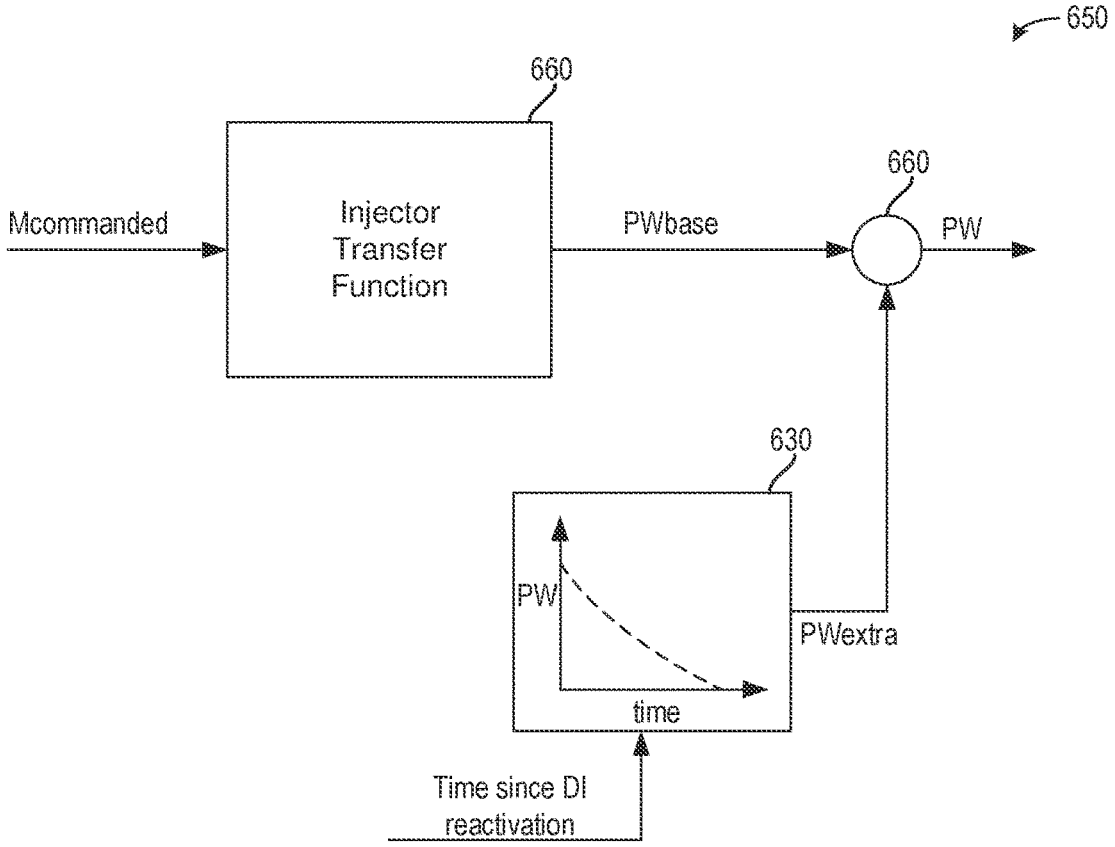
FIG. 6B illustrates an operation for utilizing a PW from the PW look-up table.

Returning to 510, if the solenoid resistance is greater than the threshold resistance, then the method 500 proceeds to 512, which includes executing a transient PBIB and applying extra PW based on the transient PBIB feedback and a PW schedule. An example PW schedule is illustrated in FIG. 6B, wherein the PW schedule is learned based on feedback from the transient PBIB as shown in FIG. 6A.

The method 500 may proceed to 512, which includes not updating a steady state PBIB. In this way, when the transient PBIB model is executed, the steady state PBIB model is neither executed nor updated.

The method 500 may proceed to 514, which includes determining if a solenoid resistance is equal to or less than the threshold resistance. If the solenoid resistance is still greater than the threshold resistance and the transient state is still occurring, then the method 500 may proceed to 516, which includes continuing to execute the transient PBIB model and applying extra PW.

If the solenoid resistance is less than or equal to the threshold resistance, then a steady state has been reached. As such, the method 500 may proceed to 518, which includes deactivating the transient PBIB and no longer applying extra PW based on transient PBIB feedback. The method 500 may proceed to 511 as described above.

In one example, PBIB may be configured to correct each individual injector's transfer function so that the system would operate as if the engine had an ideally matched set of injectors in it (e.g., injectors inject identically). However, following a period of DI disuse, the DI injections may be lean until, following a first order exponential curve, it reaches a steady state value. The fix for this was to compensate for the "missing" fuel based on the theory provided in the prior art by basing correction factors on an injector tip temperature. However, the inventors have found that the initial (and transient) high temperature of a solenoid coil, which results in high resistance, low current, low force, and therefore a slow opening time. A measured coil resistance/temperature is determined and a steady state resistance/temperature and transient resistance/temperature is determined. Second, we apply the correction appropriate for a slow injection opening time (addend) instead of as a factor based on a transient PBIB feedback. Of course, since coil resistance is electrically sensed, it may not be modeled. However, the solenoid coil resistance or temperature may be compared to a threshold resistance or temperature, respectively to determine if a transient condition or steady state condition is occurring.

Thus, in the example of the present disclosure, a first PBIB and a second PBIB may be learned. The first PBIB may correspond to a steady state PBIB and the second PBIB may correspond to a transient PBIB. One of the two PBIBs being selected based on the comparison between the solenoid coil resistance to the threshold resistance or the solenoid coil temperature to the threshold temperature. If a transient condition is occurring the fueling errors sensed via the transient PBIB may be learned in combination with inductive signature measurements (e.g., a PW measurement).

Turning to FIG. 6A, it shows an embodiment 600 for updating a look-up table. A commanded mass of fuel and an actual mass of fuel are input into a difference calculator at 610 via feedback from the transient PBIB. The commanded mass of fuel and the actual mass of fuel are sensed during an initial phase of a reactivation of direct injectors. As described above, fueling may be leaner than desired due to inactivity of the direct injectors based on a solenoid coil being hot. As such, a difference may be determined between the actual mass of fuel and the commanded amount of fuel. The difference (e.g., $M_{error}$) may be input to an integral gain 620 to produce an $M_{increment}$ value, which corresponds to a pulse width correction. The pulse width correction may be time-stamped so that the pulse width correction may be applied at the desired time and to a desired injector. That is to say, the pulse width correction may correspond to an extra pulse width applied at a specific time point and to a specific injector. Graph 630 illustrates an example of the extra-pulse width applied following reactivation of the direct injectors. The extra pulse width is plotted against time, wherein time zero corresponds to a start of the reactivation of the direct injectors and when the plot intersects time, then the extra pulse width is no longer applied as the actual fuel mass sensed by PBIB relative to a commanded fuel mass reaches a value closer to 1.

Updating the direct injectors fuel pulse with the correction factors may include adjusting one or more injection parameters such as a pulse width of the direct injectors injection, an injection pressure, and an injection amount. In one particular example, on a first pulse following the direct injectors reactivation, a pulse width of the direct injection may be increased over the initial fuel pulse width, and over subsequent pulses, the pulse width of the direct injection may be gradually decreased towards the initial fuel pulse width. As such, the pulse width adjustments (including a magnitude of the adjustment and a rate of the adjustment) may be performed on a fueling event-by-fueling event basis taking into the account the change in fuel temperature due to the fuel conditions and the direct injector conditions on each fueling event. For example, the adjustments may take into the account the change in solenoid coil resistance and/or temperature. Thus, the increase in pulse width relative to steady state on the first pulse during the transient following the direct injector reactivation may be larger than the increase in pulse width on the subsequent direct injector fuel pulse.

It will be appreciated that while the example of FIG. 6A describes a direct injector fuel pulse adjustment for when direct injector is reactivated following a period of engine fueling via port injection only. The fuel pulse adjustment is based on a sense solenoid coil resistance, which may be sensed without a fuel injection occurring. Thus, the extra PW width may be applied to a first injection during the transient condition and may increase an actual fuel injected closer to a commanded fuel injected relative to the model of the previous example which is based on sensing injector tip temperatures. By doing this, the transient PBIB may be updated over time, which is then used to update the extra PW schedule (plot 630) to further improve injector adjustments during the transient condition.

Turning to FIG. 6B, it shows an embodiment 650 of applying the corrected pulse width during a reactivation of the direct injectors. The $M_{commanded}$ is input into an input transfer function 660. The input transfer function 660 may further receive a bulk modulus input and/or a fuel rail pressure input. The injector transfer function 660 may output a $PW_{base}$ value. The $PW_{base}$ value may be a PW provided during a steady state operation. In one example, the actual fuel injected divided by a commanded fuel quantity may be equal to about 1 during the steady state operation based on steady state PBIB feedback. However, the actual fuel injected, with only the $PW_{base}$ divided by a commanded fuel quantity may be equal to a value less than one (e.g., between 0.5 and 1) as determined by the transient PBIB. However, the extra pulse width ($PW_{extra}$) determined via the plot 630 is added to the $PW_{base}$ at 670, wherein the $PW_{extra}$ was learned during previous transient operating conditions are described above with respect to FIG. 6A. As such, the resulting actual fuel injected is closer to the commanded fuel injection via addition of the $PW_{extra}$ to the $PW_{base}$.

In a real-world example, the direct injectors are deactivated due to an engine load being less than a threshold load. In one example, the threshold load is a high load or a mid load. The PFI are active and injecting fuel into an intake port of the engine. During this time, the DI may be heated to temperatures higher than desired during DI operation. This heating may result in a heated solenoid coil due to a lack of cooling via injecting fuel. As such, the resistance and thus, a voltage used to operate the direct injectors during a transient operation condition may be higher than a voltage used during a steady state operation. In response to the DI being reactivated and a sensed coil resistance is greater than a threshold resistance, the extra pulse width may be applied to the base pulse width based on feedback from a transient PBIB model and the PW schedule. The extra pulse width may be determined via a data stored in a look-up table (e.g., plot 630) with at least one input being time since the DI reactivation started. The extra PW may decrease as the time since the start of the DI reactivation increases. Thus, the mass fuel injected divided by a commanded fuel mass value may increase toward 1 as the reactivation progresses and the demand for the extra PW to correct the lean fueling error may also decrease.

As another real-world example, if an engine operation includes where the PFI are injecting and the DI are not injecting, then the coil resistance of the DI is sensed upon reactivation of the DI. If the coil resistance is less than or equal to the threshold resistance, then the steady state PBIB is selected and extra PW is not provided to the DI. However, if following reactivation of the DI, the coil resistance is greater than the threshold resistance, then the transient PBIB is selected. The transient PBIB senses an amount of fuel injected and determines a fueling error based on a difference between the amount of fuel injected and a commanded amount. The fueling error is converted to an extra PW needed to overcome the difference (e.g., correct the fueling error). The transient PBIB continues to sense fueling errors during the restart, and extra PWs are learned during this time. Thus, during a future transient condition, the extra PW is applied and the error is reduced. However, the error may still be present. Therefore, the transient PBIB and the extra PW may be updated via learned errors to enhance transient DI injections.

Turning now to FIG. 7, it shows a graph 700 illustrating an engine operating sequence for adjusting a DI operating parameter during a restart following a period of deactivation while PFI are still active. Plot 710 illustrates a DI status. Plot 720 illustrates a PFI status. Plot 730 illustrates a mass fuel injected divided by a commanded fuel mass and dashed plot 732 illustrates a transient a mass fuel injected divided by a commanded fuel mass that would occur without a pulse width correction (e.g., extra pulse width). Plot 740 illustrates a pulse width duration and dashed line 742 illustrates pulse width base without the addition of the pulse width correction. Plot 750 illustrates a solenoid coil resistance and dashed line 750 illustrates a threshold resistance. Time is illustrated on the abscissa and increases from a left to a right side of the figure.

Prior to t1, the direct injectors (DI) status is on (plot 710). Furthermore, the port-fuel injectors (PFI) status is on (plot 720). The mass fuel injected divided by a commanded fuel mass (e.g., steady state PBIB feedback) oscillates in a stepwise manner at a value near 1 (plot 730). That is to say, the steady state PBIB is executed prior to t1 and the transient PBIB is not in response to the solenoid resistance being less than the threshold resistance (plot 750 and dashed line 752, respectively). The pulse width duration is equal to a pulse width base value, which is illustrated between a relatively long duration and a relatively short duration (plot 740).

At t1, the DI status is switched to off. As such, the DI do not inject fuel to the cylinders between t1 and t2. The DI may be deactivated in response to an engine load decreasing or other condition. As such, the mass fuel injected divided by a commanded fuel mass value is unavailable between t1 and t2. The PFI remain activated, thereby resulting in the engine being fueled and combustion occurring. During this time, the DI may be heated without cooling via injecting taking place. That is to say, as the DI inject fuel, the lower temperature of the fuel may cool various component of the DI, including an injector tip, an injector solenoid, and the like. As the DI are heated, the solenoid coil may also be heated, which may increase its resistance. As illustrated, the solenoid resistance increases to a relatively high solenoid resistance greater than the threshold resistance.

At t2, the DI are reactivated and the PFI injectors remain active. Between t2 and t3, the DI reactivation occurs as the solenoid resistance is greater than the threshold resistance, resulting in a transient DI reactivation occurring. Thus, the transient PBIB is executed and the steady state PBIB is not executed. During this transient phase, which may include a plurality of fuel injections, a correction to DI parameters is applied based on the transient PBIB learning and PW updates described in FIGS. 6A and 6B. The mass fuel injected divided by the commanded fuel of the DI is equal to about 1 from the entirety of the transient phase via the extra pulse width provided. As illustrated, the pulse width is increased to a long duration at the start of the transient phase, wherein the duration decays along a break point curve until the mass fuel injected divided by a commanded fuel mass is constant without the extra pulse width. In one example, the extra pulse width may correspond to a longer opening time or to a shorter closing time. As a result of the extended pulse width, the mass fuel injected divided by a commanded fuel mass value following a transient pattern 832 is avoided. Between t2 and t3, the transient PBIB may be updated while the steady state PBIB is not updated to avoid undesired learning behaviors.

At t3, the extra pulse width is terminated in response to the solenoid resistance being less than or equal to the threshold resistance. After t3, a base pulse width, similar to a pulse width applied prior to t1, may be used to maintain a desired mass fuel injected divided by a commanded fuel mass value of the DI. Furthermore, the transient PBIB is deactivated and the steady state PBIB is activated. The DI and PFI remain active and supply fuel to the engine.

An embodiment of a method comprising blocking updates to a steady state PBIB model in response to a reactivation of a plurality of direct injectors following a period of deactivation. A first example of the method further includes where the period of deactivation further comprises where port-fuel injectors are active and fueling an engine. A second example of the method, optionally including the first example, further includes updating the steady state PBIB model in response to a solenoid resistance being less than or equal to a threshold resistance following the reactivation. A third example of the method, optionally including one or more of the previous examples, further includes where blocking updates to the steady state PBIB model occurs during a transient phase of the reactivation where the solenoid resistance is greater than the threshold resistance. A fourth example of the method, optionally including one or more of the previous examples, further includes where providing an extra pulse width in addition to a base pulse width, wherein the base pulse width is provided in response to the solenoid coil resistance being less than or equal to the threshold resistance. A fifth example of the method, optionally including one or more of the previous examples, further includes where the extra pulse width is reduced as the transient phase progresses.

An embodiment of a system comprises an engine comprising a plurality of cylinders including a plurality of port-fuel injectors and a plurality of direct injectors and a controller comprising computer-readable instructions stored on non-transitory memory thereof that when executed enable the controller to sense a solenoid coil resistance in response to the plurality of direct injectors being reactivated following a period of deactivation, in response to the solenoid resistance being less than or equal to a threshold resistance, executing a steady-state a pressure-based injector balancing (PBIB) model, and in response to the pressure ratio being greater than the threshold resistance, executing a transient PBIB model and blocking updates to the steady PBIB model, further comprising applying an extra pulse width in addition to a base pulse width to the plurality of direct injectors. A first example of the system further includes where the instructions further enable the controller to retrieve the extra pulse width from a look-up table, wherein the extra pulse width is based on a time since a reactivation of the plurality of direct injectors. A second example of the system, optionally including the first example, further includes where the extra pulse width decreases as the time since the reactivation increases. A third example of the system, optionally including one or more of the previous examples, further includes where the extra pulse width is updated in response to an actual fuel mass being less than a commanded fuel mass following addition of the extra pulse width to the base pulse width. A fourth example of the system, optionally including one or more of the previous examples, further includes where the look-up table is a graph, and wherein the graph is a breakpointed curve comprising a first rate of decrease and a second rate of decrease, wherein the first rate of decrease corresponds to a beginning of the reactivation. A fifth example of the system, optionally including one or more of the previous examples, further includes where the second rate of decrease is less than the first rate of decrease. A sixth example of the system, optionally including one or more of the previous examples, further includes where applying the extra pulse width is independent of a fuel injector tip temperature. A seventh example of the system, optionally including one or more of the previous examples, further includes where the plurality of direct injectors are positioned to inject directly into a combustion chamber volume and wherein the plurality of port-fuel injector are positioned to inject into intake ports outside of the combustion chamber volume. An eighth example of the system, optionally including one or more of the previous examples, further includes where instructions to adjust a radiator fan operation to decrease a cylinder head temperature to less than a desired cylinder head temperature range, and wherein the steady state PBIB model is updated when the cylinder head temperature is less the desired cylinder head temperature range.

An embodiment of a method comprises executing a transient pressure-based injector balancing (PBIB) model in response to a resistance of a solenoid coil of an injector being greater than a threshold resistance. A first example of the method further includes where executing a steady-state PBIB model in response to the resistance of the solenoid coil being less than or equal to the threshold resistance. A second example of the method, optionally including the first example, further includes where the injector is a direct injector positioned to inject directly into a combustion chamber of an engine, where the direct injector is active when the transient PBIB or the steady-state PBIB are being executed. A third example of the method, optionally including one or more of the previous examples, further includes where the transient PBIB and the steady-state PBIB are executed separately. A fourth example of the method, optionally including one or more of the previous examples, further includes applying only a base pulse width to the solenoid coil during the steady-state PBIB. A fifth example of the method, optionally including one or more of the previous examples, further includes applying the base pulse width and an extra pulse width to the solenoid coil during the transient PBIB. A sixth example of the method, optionally including one or more of the previous examples, further includes determining the extra pulse width based on an injecting error, wherein the injecting error is based on a difference between an actual amount of fuel injected and a commanded amount of fuel to inject, wherein the actual amount of fuel injected is determined via the transient PBIB model. A seventh example of the method, optionally including one or more of the previous examples, further includes where the resistance increases as a solenoid coil temperature increases.

An embodiment of a system comprises an engine, a plurality of cylinders comprising a plurality of port-fuel injectors and a plurality of direct injectors, and a controller comprising computer-readable instructions stored on non-transitory memory thereof that when executed enable the controller to sense a resistance of a solenoid coil, execute a transient pressure-based injector balancing (PBIB) in response to the plurality of direct injectors being active and the resistance of the solenoid coil being greater than a threshold resistance, and execute a steady-state PBIB in response to the plurality of direct injectors being active and the resistance of the solenoid coil being less than or equal to the threshold resistance. A first example of the system further includes where the instructions further enable the controller to sense a temperature of the solenoid coil, wherein the instructions further enable the controller to execute a transient PBIB in response to the plurality of direct injectors being active and the temperature of the solenoid coil being greater than a threshold temperature. A second example of the system, optionally including the first example, further includes where the instructions further enable the controller to execute the steady-state PBIB in response to the plurality of direct injectors being active and the temperature of the solenoid coil being less than or equal to the threshold temperature. A third example of the system, optionally including one or more of the previous examples, further includes where the instructions further enable the controller to adjust a fan operation in response to the transient PBIB or the steady-state PBIB being executed, wherein the fan operation is adjusted to decrease a cylinder head temperature to a temperature less than a desired cylinder head operating temperature range. A fourth example of the system, optionally including one or more of the previous examples, further includes where the instructions further enable the controller to adjust the fan operation to maintain the cylinder head temperature to a temperature within the desired cylinder head operating temperature range. A fifth example of the system, optionally including one or more of the previous examples, further includes where the instructions further enable the controller to apply a base pulse width to the solenoid coil during the steady-state PBIB, and wherein the instructions further enable the controller to apply the base pulse width and an extra pulse width to the solenoid coil during the transient PBIB. A sixth example of the system, optionally including one or more of the previous examples, further includes where the extra pulse width is based on an injecting error sensed by the transient PBIB of a direct injector of the plurality of direct injectors, wherein the injecting error is equal to a difference between an actual amount of injected fuel and a commanded amount.

An embodiment of a method, comprises selecting to execute one of a transient pressure-based injector balancing (PBIB) or a steady-state PBIB in response to a resistance of a solenoid coil of a direct injector and adjusting a fan operation during execution of one of the transient PBIB or the steady-state PBIB to decrease a cylinder head temperature to a temperature less than a desired cylinder head temperature. A first example of the method further includes where the fan operation comprises a first mode and a second mode, wherein the first mode oscillates a fan speed and adjusts the cylinder head temperature to equal to an average temperature, wherein the average temperature is equal to the desired cylinder head temperature, and wherein the second mode maintains a constant fan speed and adjusts the cylinder head temperature to the temperature less than the desired cylinder head temperature, and wherein the method further includes selecting the first mode when the transient PBIB and the steady-state PBIB are not being executed and selecting the second mode when one of the transient PBIB or the steady-state PBIB is being executed. A second example of the method, optionally including the first example, further includes selecting to execute one of the transient PBIB or the steady-state PBIB in response to a temperature of the solenoid coil. A third example of the method, optionally including one or more of the previous examples, further includes adding an extra pulse width to a base pulse width applied to the solenoid coil during the transient PBIB, further comprising learning the extra pulse width based on fueling errors determined via the transient PBIB during transient operation of the direct injector, wherein the extra pulse width is proportional to a fueling error of the direct injector. A fourth example of the method, optionally including one or more of the previous examples, further includes decreasing the extra pulse width added to the base pulse width as transient operation of the direct injector progresses.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system of an engine, the system comprising:

a plurality of cylinders comprising a plurality of port-fuel injectors and a plurality of direct injectors; and a controller comprising computer-readable instructions stored on non-transitory memory thereof that when executed enable the controller to:

sense a resistance of a solenoid coil;

execute a transient injector diagnostic in response to the plurality of direct injectors being active and the resistance of the solenoid coil being greater than a threshold resistance, the transient injector diagnostic comprising a base pulse width and an extra pulse width applied to the solenoid coil; and execute a steady-state injector diagnostic in response to the plurality of direct injectors being active and the resistance of the solenoid coil being less than or equal to the threshold resistance, the steady-state injector diagnostic comprising only the base pulse width applied to the solenoid coil.

2. The system of claim 1, wherein the instructions further enable the controller to sense a temperature of the solenoid coil, wherein the instructions further enable the controller to execute the transient injector diagnostic in response to the plurality of direct injectors being active and the temperature of the solenoid coil being greater than a threshold temperature.

3. The system of claim 2, wherein the instructions further enable the controller to execute the steady-state injector diagnostic in response to the plurality of direct injectors being active and the temperature of the solenoid coil being less than or equal to the threshold temperature.

4. The system of claim 1, wherein the instructions further enable the controller to adjust a fan operation in response to the transient injector diagnostic or the steady-state injector diagnostic being executed, wherein the fan operation is adjusted to decrease a cylinder head temperature, the cylinder head temperature sensed via a temperature sensor.

5. The system of claim 4, wherein the instructions further enable the controller to adjust the fan operation to maintain the cylinder head temperature.

6. The system of claim 1, wherein the extra pulse width is based on an injecting error sensed by the transient injector diagnostic of a direct injector of the plurality of direct injectors, wherein the injecting error is equal to a difference between an actual amount of injected fuel and a commanded amount.

* * * * *